US005287592A

United States Patent [19]

Kopco

[11] Patent Number: 5,287,592

[45] Date of Patent: Feb. 22, 1994

[54] ELECTRICALLY INSULATING BELT DRIVE FOR VACUUM CLEANER MOTOR ASSEMBLY

[75] Inventor: James J. Kopco, Mentor-on-the-Lake, Ohio

[73] Assignee: Royal Appliance Mfg. Co., Cleveland, Ohio

[21] Appl. No.: 2,212

[22] Filed: Jan. 8, 1993

[51] Int. Cl.[5] ..... A47L 9/00

[52] U.S. Cl. ..... 15/339; 15/391

[58] Field of Search ..... 15/359, 391, 339; 474/111, 140

[56] References Cited

U.S. PATENT DOCUMENTS

| | | | |
|---|---|---|---|
| 1,972,745 | 9/1934 | Martinet | 15/389 |
| 2,139,146 | 12/1938 | Becker | 15/389 |
| 2,888,828 | 6/1959 | Hall | 15/389 X |
| 4,315,343 | 2/1982 | Neroda et al. | 15/339 |
| 4,633,543 | 1/1987 | Sovis et al. | 15/344 |

*Primary Examiner*—Chris K. Moore

*Attorney, Agent, or Firm*—Fay, Sharpe, Beall, Fagan, Minnich & McKee

[57] ABSTRACT

A vacuum cleaner assembly includes a motor and drive shaft extending therefrom adapted for driving an elastomeric belt which, in turn, is used to rotate a revolving brush supported in a cleaner housing. A composite belt drive member is affixed in axial alignment to an end of the motor shaft and has a relatively rigid member and electrically insulating annular oversheath. The sheath is tapered to provide a nest portion for retaining the belt on the drive member during shaft rotation. The sheath is a plastic material which provides the desired electrical insulation function.

7 Claims, 1 Drawing Sheet

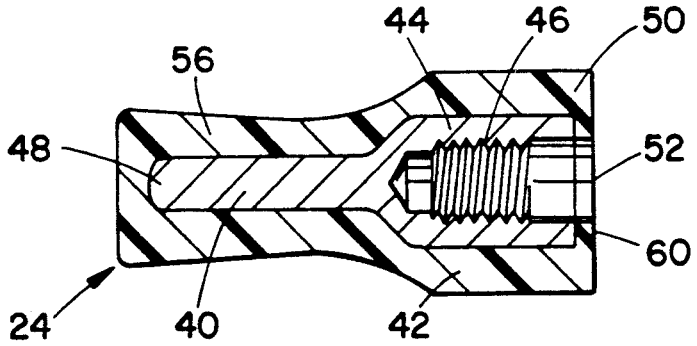
FIG. 2
FIG. 1
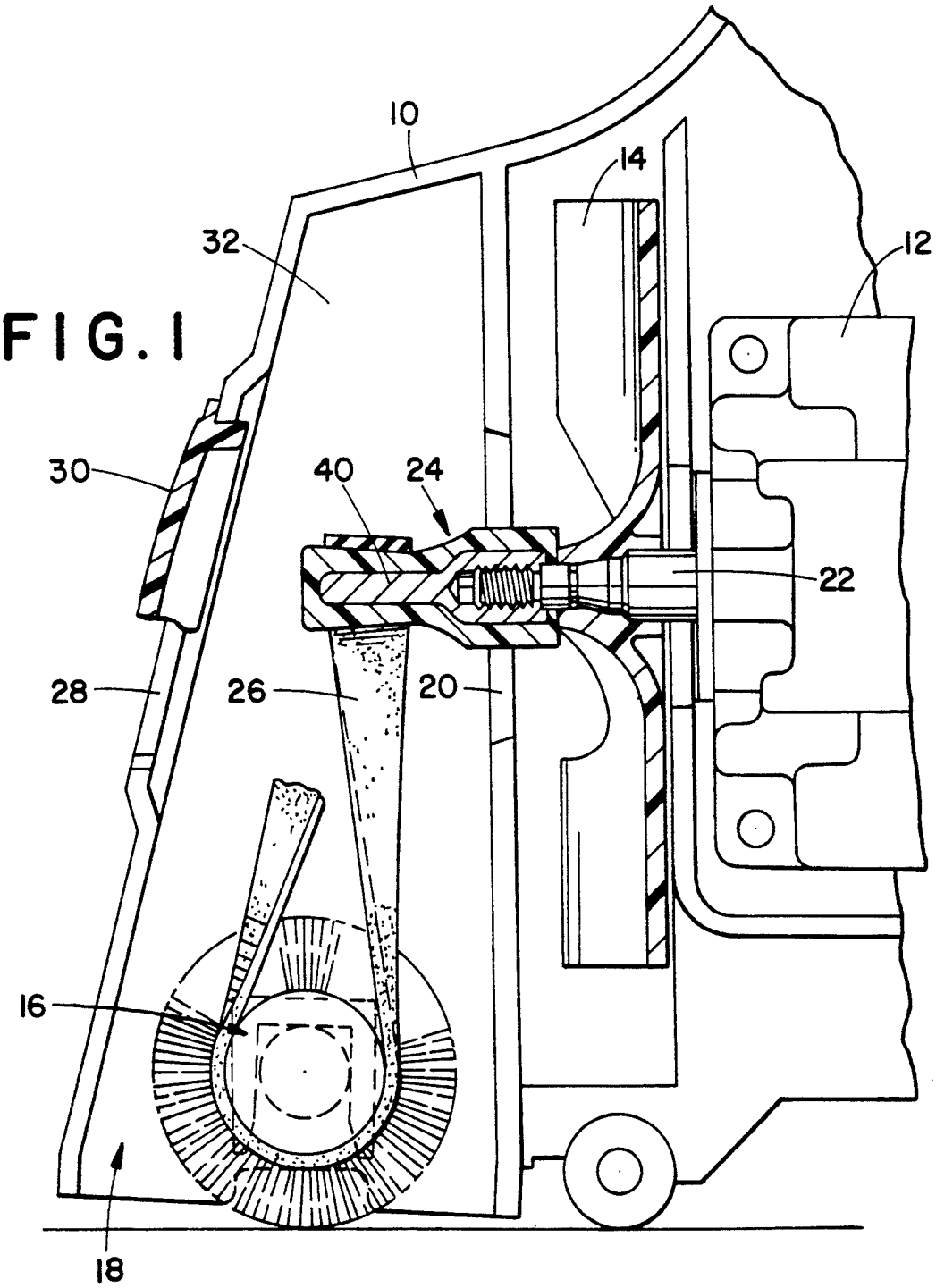

ELECTRICALLY INSULATING BELT DRIVE FOR VACUUM CLEANER MOTOR ASSEMBLY

BACKGROUND OF THE INVENTION

This invention pertains to the art of vacuum cleaner devices and more particularly to motor and drive assemblies.

The invention is particularly applicable as an electrically insulating belt drive for vacuum cleaners having a rotating brush powered by a belt running from the motor shaft to the brush.

Various forms and types of belt drives are known in the vacuum cleaner industry. Most use an elastomeric belt driven by an electric motor that also powers a fan to create the vacuum necessary for suction cleaning U.S. Pat. No. 4,633,543 shows such an arrangement where a motor shaft extension is used as a belt drive.

Frequently, it is necessary to access the belt either for replacement or for removal in those situations where a separate suction hose may be attached to the cleaner as an accessory tool. In the above cited patent, the vacuum cleaner housing includes an opening which is intended to be readily accessible to a user of the cleaner to allow attachment of the tool. Such attachment requires removal of the belt from the belt drive. If the belt is subsequently reattached by hand, without use of a special belt attachment tool, the operator's hands may contact the belt drive. The shaft extension comprising the belt drive is one insulation layer away from electrical communication with the motor. There is electrical insulation between the motor shaft and the armature. Accordingly, for safety reasons it has been desired that a system be provided in which the shaft extension is doubly electrically insulated from the motor to prevent electrical shock to an operator.

More importantly, current safety standards suggest that a consumer appliance of this type should be so doubly-insulated, that is, that at least two layers of insulation should exist between the motor and the user. With a metallic belt drive only a single layer exists between the motor shaft and the armature.

The shaft extension has normally been metallic due to operating requirements of heavy loads and high temperatures as a part of its normal use. Substitution of a mere plastic material for a metal belt drive has proved unsuccessful since most plastic materials are unable to withstand the loads and heat and those that are, are not cost acceptable as part of the product.

The present invention contemplates a new and improved shaft extension for a vacuum cleaner motor which overcomes the above-identified problems and others to provide a new belt drive which is simple in design, economical to manufacture and which sufficiently electrically insulates the motor from an operator to avoid unsafe exposure to potential electrical shock problems.

BRIEF SUMMARY OF THE INVENTION

In accordance with the present invention, there is provided a vacuum cleaner assembly including a motor and a drive shaft extending therefrom adapted for driving an elastomeric belt which in turn is used to rotate a revolving brush supported in a cleaner housing. A composite belt drive member is affixed in axial alignment to an end of the motor shaft and has a relatively rigid insert member and electrically insulating annular sheath. The sheath is tapered to provide a nest portion for retaining the belt on the drive member during shaft rotation. The insert member has a knurled outer surface so that the sheath remains fixed relative to the insert and motor shaft. The sheath is a plastic material which can withstand the temperatures and loads of driving a vacuum cleaner belt while still providing the desired electrical insulation function.

The primary benefit of the present invention is a belt drive member which electrically insulates the drive belt from the motor.

Other benefits and advantages for the invention will become apparent to those skilled in the art upon a reading and understanding of the specification.

BRIEF DESCRIPTION OF THE DRAWINGS

The invention may take physical form in certain parts and arrangements of parts, the preferred embodiments of which will be described in detail in the specification and illustrated in the accompanying drawings which form a part hereof and wherein:

FIG. 1 is an enlarged partial cross-sectional view of a vacuum cleaner formed in accordance with the present invention; and, FIG. 2 is an enlarged cross-sectional view of a belt drive member shown in FIG. 1.

DETAILED DESCRIPTION OF THE INVENTION

Referring now to the drawings wherein the showings are for purposes of illustrating the preferred embodiments of the invention, and not for purposes of limiting same, the FIGURES show a vacuum cleaner device comprised of a housing 10 including a motor 12, fan 14 and revolving brush assembly 16. The dirt path through the cleaner is through the nozzle 18, through the rear nozzle chamber opening 20, through the fan 14 and through a working air chamber 16 to a bag assembly (not shown). A complete illustration of the entire cleaner is shown in U.S. Pat. No. 4,633,543 which is herein incorporated by reference.

The motor includes a shaft 22 to which is attached the fan 14. A shaft extension comprising drive belt member 24 is threadedly received on the shaft 22 to lock the fan 14 to the shaft. In addition, the drive member is associated with an elastomeric belt 26 for communicating the rotating movement of the motor shaft to the revolving brush 16. Access to the drive belt member and the belt itself is made through a front nozzle chamber opening 28 which, during normal operation, is closed by an elastomeric cap 30 (shown in partial section). The belt drive 24 is normally exposed to heavy loads by the belt 26 and friction induced heat from the belt 26 or the brush 16. As noted above, such drive belt members or pulleys have heretofore been constructed of metal and therefore provide a path of electric communication from the motor into the nozzle chamber 32.

The subject invention comprises a vacuum cleaner motor assembly in which the drive belt member electrically insulates the drive belt from the motor. shaft The drive belt member 24 has a relatively rigid insert member 40 and an electrically insulating annular sheath 42. The insert member 40 has a first portion 44 including a recess 46 sized to closely receive a terminal end portion of the motor shaft 22. A second portion 48 axially depends from the first portion in a generally cylindrical configuration and comprises a means for rigidly supporting the sheath 42. The sheath 42 is disposed over the insert 46 and has a generally annular circumferential configuration comprising a sheath first portion 50 encompassing the insert member first portion and having an end opening 52 accommodating access of the motor shaft 22 into the insert member recess 46. A sheath second portion 56 encompasses the insert member second portion 48 and has an axially tapering outer surface towards a terminal end of the belt drive 24 comprising a radially expanding circumference in a direction away from the sheath first portion. The drive belt 26 nests on the tapering outer surface. The taper cooperates with the sheath first portion which effectively comprises a circumferentially expanded shoulder relative to the sheath's second portion for retaining a drive belt on the sheath's second portion. The sheath first portion 50 includes a radially inwardly depending lip 60 at the end opening and the insert member 40 has a generally knurled outer surface whereby the sheath will remain fixed relative to the insert member and motor shaft during operation. The belt drive is threadedly fastened to the motor shaft in the insert member recess and the recess 46 is sized to avoid the motor shaft bottoming out therein, wherein the depending lip engages the fan 14 upon the belt drive member being fully threaded thereon to lock the fan onto the shaft and preclude an air gap formation between the belt drive member and the fan. This assures double electrical insulation of the motor shaft. (The first layer is between the motor shaft and the armature (not shown).) The insert is preferably constructed of steel, while the sheath comprises a mineral and glass reinforced phenolic thermoset material (Fiberite FM4017F), although it is in the scope of the invention to use alternative electrically insulating materials. The belt is received on the drive belt member 24 to continually urge tightening of the member 24 on the shaft 22 during operation.

The invention has been described with reference to the preferred embodiment. Obviously, modifications and alterations will occur to others upon the reading and understanding of the specification. It is my intention to include all such modifications and alterations in so far as they come within the scope of the appended claims or the equivalents thereof.

Having thus described our invention, I now claim:

1. A vacuum cleaner motor assembly including a motor and a drive shaft extending therefrom, particularly adapted for electrically insulating a drive belt from the motor comprising:

a belt drive member affixed in axial alignment to an end of the motor shaft and having a relatively rigid insert member and an electrically insulating annular sheath, the insert member having a first portion including a recess sized to closely receive a terminal end portion of the motor shaft and a second portion, axially depending therefrom, comprising a means for rigidly supporting the sheath, the sheath being disposed over the insert and comprising a sheath first portion encompassing the insert member first portion and having an end opening accommodating access of the motor shaft into the insert member recess, and a sheath second portion encompassing the insert member second portion and having an axially tapering outer surface comprising a radially expanding circumference in a direction away from the sheath first portion, whereby the drive belt nests on the tapering outer surface while being electrically insulated from the motor shaft.

2. The assembly as defined in claim 1 wherein the sheath first portion comprises a circumferentially expanded shoulder relative to the sheath second portion and is sized for retaining the drive belt on the sheath second portion.

3. The assembly as defined in claim 1 wherein the insert member second portion has a cylindrical configuration.

4. The assembly as defined in claim 1 wherein sheath includes a radially inwardly depending lip at the end opening and the insert member has a knurled outer surface whereby the sheath remains fixed relative to the insert member and the motor shaft.

5. The assembly as defined in claim 4 wherein the belt drive member is threadedly fastened to the motor shaft in the insert member recess and the recess is sized to avoid the motor shaft bottoming out therein and wherein the depending lip engages a motor fan upon the belt drive member being fully threaded thereon to preclude an air gap formation between the belt drive member and the fan and assure electrical insulation of the motor shaft.

6. The assembly as defined in claim 5 wherein the drive belt is received on the belt drive member and a rotating brush and is disposed to continually urge tightening of the belt drive member on the motor shaft during cleaner operation.

7. An electrically insulating belt drive in a vacuum cleaner housing assembly comprising a composite of a rigid metallic drive member and an electrically insulating sleeve disposed about the drive member, the belt drive having a partially threaded opening at a one end for threaded fastening on a motor shaft of a motor, the sleeve having an axial taper to form a nesting area for a drive belt received thereon, and the drive member having a generally cylindrical shaft extension terminating within the sleeve nesting area to support the sleeve and the drive belt whereby drive belt is electrically insulated from the motor by the belt drive sleeve.

* * * * *